US006894578B1

(12) United States Patent
Kishimoto et al.

(10) Patent No.: US 6,894,578 B1
(45) Date of Patent: May 17, 2005

(54) IRREVERSIBLE CIRCUIT MODULE INCLUDING A DIRECTIONAL COUPLER

(75) Inventors: Yasushi Kishimoto, Tottori-ken (JP); Hiroyuki Itoh, Tottori-ken (JP); Hideto Horiguchi, Tokyo (JP); Manabu Yumoto, Tottori-ken (JP); Youichi Takahashi, Tottori-ken (JP); Shinichirou Takeuchi, Tottori-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 191 days.

(21) Appl. No.: 09/980,938

(22) PCT Filed: Apr. 6, 2001

(86) PCT No.: PCT/JP01/03001

§ 371 (c)(1),
(2), (4) Date: Dec. 6, 2001

(87) PCT Pub. No.: WO01/78187

PCT Pub. Date: Oct. 18, 2001

(51) Int. Cl.[7] ..... H01P 1/36
(52) U.S. Cl. ..... 333/1.1; 333/24.2; 333/116
(58) Field of Search ..... 333/1.1, 24.2, 333/116

(56) References Cited

U.S. PATENT DOCUMENTS 5,929,722 A * 7/1999 Kono ..... 333/177
5,945,887 A 8/1999 Makino et al. ..... 333/1.1
6,222,425 B1 * 4/2001 Okada et al. ..... 333/1.1
2001/0017576 A1 * 8/2001 Kondo et al. ..... 333/24.2

FOREIGN PATENT DOCUMENTS

| | | | |
|---|---|---|---|
| EP | 948079 | 10/1999 | |
| JP | 09-270608 | 10/1997 | ..... H01P/1/383 |
| JP | 10-200308 | 7/1998 | |
| JP | 10-200310 | 7/1998 | |
| JP | 10-327003 | 12/1998 | |
| JP | 11-330805 | 11/1999 | |
| JP | 11-355012 | 12/1999 | |

* cited by examiner

*Primary Examiner*—Robert Pascal
*Assistant Examiner*—Stephen E. Jones
(74) *Attorney, Agent, or Firm*—Finnegan, Henderson, Farabow, Garrett & Dunner, L.L.P.

(57) ABSTRACT

An irreversible circuit module includes a permanent magnet for providing a DC magnetic field for a magnetic member; an assembly having a magnetic member provided with a plurality of conductors being common on one end and serving as input and output terminals for high-frequency signals on the other end; a plurality of load capacitors connected to the conductors, the load capacitors being formed in a laminate having a conductor layer: a first transmission line connected to any of the conductors; and a second transmission line coupled magnetically to the first transmission line. The first transmission line and the second transmission line are included in the laminate. The assembly is received in a hole in the middle of the laminate.

14 Claims, 16 Drawing Sheets

Rear Surface of 112

IRREVERSIBLE CIRCUIT MODULE INCLUDING A DIRECTIONAL COUPLER

FIELD OF THE INVENTION

The present invention relates to a non-reciprocal circuit module such as a circulator, an isolator, etc. used in a microwave communications equipment, etc. such as a mobile phone, etc.

BACKGROUND OF THE INVENTION

Wireless communications devices, for instance, mobile phones have become popular remarkably in recent years with their functions and services improved increasingly. Taking a mobile phone as an example, there are various systems for mobile phones, for instance, EGSM (extended global system for mobile communications) and DCS 1800 (digital cellular system 1800) systems widely used mostly in Europe, a PCS (personal communications services) system used in the U.S., and a PDC (personal digital cellular) system used in Japan. In a mobile phone used in such systems, it is necessary to prevent part of a transmitting output power from being reflected by the variation of impedance, etc. of an antenna, an amplifier from being damaged by this reflected electric power, and a signal of an adjacent channel from entering from an antenna to cause mutual modulation. It is also regulated, for instance, in PDC, etc. that a signal for controlling a transmitting output is sent from a base station to mobile phones to control the transmitting output power of each mobile phone.

Therefore, in a mobile phone having a transmitting circuit means having a structure shown in FIG. 18, a high-frequency signal from a modulation circuit (not shown) is amplified by an amplifier 1, and an output proportional to the high-frequency signal is taken out by a directional coupler 2 and supplied to an automatic gain control circuit 7 to control the output power of the amplifier 1. Also, a non-reciprocal circuit device (isolator) 3 placed on the downstream side of the directional coupler 2 prevents a reflected wave generated by the mismatching, etc. of characteristic impedance and line impedance in each part (an antenna 6, a low-pass filter 4 and a duplexer 5) from entering into the amplifier 1.

FIG. 19 is an exploded perspective view showing a conventional non-reciprocal circuit device. This non-reciprocal circuit device comprises a central conductor assembly 10, a resin case 12, dielectric bodies 50*a*, 50*b*, 50*c* constituting load capacitors, a permanent magnet 9, and metal cases 7, 8. The central conductor assembly 10 comprises an integral central conductor member constituted by a ground electrode formed by a thin copper plate and central conductors 14*a*, 14*b*, 14*c* radially extending therefrom in three directions, and a disc-shaped garnet (magnetic body) 13, the central conductor member encircling the disc-shaped garnet (magnetic body) 13, and the central conductors 14*a*, 14*b*, 14*c* being folded and crossing at 120° with mutual insulation at a center on the upper surface of the garnet (magnetic body) 13. The central conductor assembly 10 is placed in a recess 15 substantially at a center of the resin case 12, and the dielectric bodies 50*a*, 50*b*, 50*c* are placed in three rectangular recesses around the recess 15. The ground electrode of the central conductor member is soldered to a ground plate of the resin case 12, and the central conductors 14*a*, 14*b*, 14*c* (input/output electrodes) of the central conductor member are soldered to external electrodes of the dielectric bodies 50*a*, 50*b*, 50*c* on their upper surfaces. The permanent magnet 9 for applying a DC magnetic field to the central conductors 14*a*, 14*b*, 14*c* on the garnet 13 is placed above the central conductor assembly 10. These parts are entirely received in a pair of upper and lower metal cases 7, 8. A pair of upper and lower metal cases 7, 8 also serve as magnetic yokes to constitute a magnetic circuit, providing a non-reciprocal circuit device having an outer size of 5 mm×5 mm×1.7–2.0 mm.

However, when mobile phone having such a structure comprises a transmitting circuit means, into which the directional coupler 2, coupling capacitors, the non-reciprocal circuit device 3 and the low-pass filter 4 are incorporated as separate parts, there arise disadvantages described below.

Demand has been increasingly higher for mobile phones to make areas occupied by the directional coupler 2, the low-pass filter 4 and the amplifier 1 as small as possible for miniaturization, and to reduce the cost per function and the number of parts as much as possible for price reduction. Under such demand, though areas occupied by the directional coupler 2, the non-reciprocal circuit device 3, the low-pass filter 4 and the amplifier 1 can be reduced by miniaturizing these parts, such means has its own limits. In addition, if the non-reciprocal circuit device 3 is tried to be miniaturized simply by the miniaturization of the central conductor assembly 10 and the dielectric bodies 50*a*, 50*b*, 50*c*, there would arise the following problems: If the central conductor assembly 1 is miniaturized, the non-reciprocal circuit device deviates from the optimally operable size as a magnetic body. In addition, if a dielectric material having a high dielectric constant is used to miniaturize the dielectric body, loss by the dielectric material increases relatively, resulting in deterioration in electric characteristics as the non-reciprocal circuit device.

If miniaturized, the directional coupler 2 has extremely deteriorated isolation characteristics. Because of the deterioration of isolation characteristics, directivity, one of the important characteristics of the directional coupler 2, cannot sufficiently be obtained. As a result, part or all of the reflected wave in a direction opposite to the traveling direction of the transmitting signal flows into the coupling terminal P5, failing to obtain the desired degree of coupling. Further, a new matching circuit should sometimes be added to achieve impedance matching between the directional coupler and the non-reciprocal circuit device. Incidentally, the directivity is determined by the following equation:

Directivity=isolation between output terminal and coupling terminal−amount of coupling, which should be at least 10 dB or more.

Further, the directional coupler 2 suffers from an insertion loss, which mainly comprises coupling loss and conductor loss, and the non-reciprocal circuit device 3 and the low-pass filter 4 have insertion loss. Accordingly, when they are used as separate parts, the loss of each part is accumulated, resulting in large loss in the overall transmitting circuit means. Loss in the transmitting circuit means leads to increase in power consumption, and this loss is not ignorable for mobile phones having limited battery capacities.

To solve such problems, Japanese Patent Laid-Open No. 9-270608 proposes that output in proportion to a high-frequency signal is taken out from a capacitor (output-detecting capacitance) branched from the input terminal of an isolator, that the output is supplied to an automatic gain control circuit to control the output power of an amplifier, and that the output-detecting capacitor is formed in an integral laminate constituted by laminating dielectric sheets together with load capacitors of the isolator.

However, when the output-detecting capacitance is used, sufficient directivity cannot be obtained due to the influence of parasitic capacitance. Therefore, unless an output-detecting capacitor designed by taking interference between electrode patterns into sufficient consideration is formed in the laminate, the desired coupling would not be obtained.

When the coupling of 20 dB is sought, the output-detecting capacitance should be as small as 0.15 pF, resulting in difficulty in control, and large variation in the coupling due to unevenness in production and parasitic capacitance. In addition, the interference between electrode patterns makes further miniaturization substantially difficult.

OBJECT OF THE INVENTION

Accordingly, an object of the present invention is to provide a non-reciprocal circuit module having the functions of a non-reciprocal circuit device and a directional coupler to suppress the number and area of parts mounted and production cost.

Another object of the present invention is to provide a non-reciprocal circuit module with small loss and further provided with the function of a low-pass filter.

A further object of the present invention is to provide a non-reciprocal circuit module provided with a high-frequency power amplifier.

SUMMARY OF THE INVENTION

The first non-reciprocal circuit module of the present invention comprises (a) a permanent magnet for applying a DC magnetic field to a magnetic body, (b) an assembly comprising a plurality of central conductors and the magnetic body placed therein, each of the central conductors having a common terminal at one end and an input/output terminal for a high-frequency signal at the other end, (c) a plurality of load capacitors formed in a laminate constituted by a plurality of dielectric layers having conductor layers and connected to the central conductor, (d) a first transmission line connected to any one of the central conductors, and (e) a second transmission line magnetically coupled to the first transmission line, the first transmission line and the second transmission line being formed in the laminate.

In this non-reciprocal circuit module, a high-frequency signal from an amplifier is supplied to the terminal P1 of the first transmission line formed in the laminate. The second transmission line is formed in the laminate such that it is magnetically coupled to the first transmission line. As a result, part of the high-frequency signal appears on the second transmission line, whereby high-frequency electric power in proportion to the high-frequency signal is supplied from a terminal P5 formed in the non-reciprocal circuit module to the automatic gain control circuit. On the other hand, the high-frequency signal is transmitted to the terminal P2 and then supplied to the non-reciprocal circuit device. The high-frequency signal supplied through the terminal P2 is transmitted to the garnet via the central conductor in the assembly, in which the traveling direction of the high-frequency signal is turned by 120° under the function of a DC magnetic field applied from the permanent magnet to the garnet. As a result, the high-frequency signal is transmitted to the central conductor connected to the terminal P3, from which it is output.

The first and second transmission lines cooperating to constitute the directional coupler are formed as laminate constituents in the laminate constituted by a plurality of dielectric layers having conductor layers, together with a plurality of load capacitors constituting the non-reciprocal circuit device. With this structure, impedance matching between the non-reciprocal circuit device and the directional coupler can easily be achieved.

The impedance of the directional coupler is determined by the width of a transmission line constituting the directional coupler, and its distance from the ground surface, etc. The impedance of the non-reciprocal circuit device is determined by the materials and shapes of the magnetic body and the central conductors constituting the central conductor assembly, and the magnetic force of the permanent magnet. Though the characteristic impedance of the directional coupler and the non-reciprocal circuit device is generally set at 50Ω, it inevitably varies to some extent when the directional coupler and the non-reciprocal circuit device are constituted as separate devices, due to inevitable unevenness in production for instance, unevenness in the thickness of the dielectric layer, the line width of the transmission line, the magnetic force of the magnetic body, etc.

Accordingly, simple combination of the directional coupler and the non-reciprocal circuit device causes impedance mismatching at the input/output terminal P2, resulting in deterioration in insertion loss characteristics. However, when two transmission lines constituting the directional couplers and load capacitors constituting the non-reciprocal circuit device are integrally formed in the laminate, the characteristic impedance of the non-reciprocal circuit device can be matched to that of the directional coupler by adjusting the DC magnetic field from the permanent magnet, thereby extremely reducing the impedance mismatching at the terminal P2. In addition, by forming the load capacitors and the first and second transmission lines as laminate constituents in the laminate constituted by a plurality of dielectric layers having conductor layers, the non-reciprocal circuit module can be miniaturized.

The second non-reciprocal circuit module of the present invention comprises (a) a permanent magnet for applying a DC magnetic field to a magnetic body, (b) an assembly comprising a plurality of central conductors and the magnetic body placed therein, each of the central conductors having a common terminal at one end and an input/output terminal for a high-frequency signal at the other end, and (c) a laminate comprising a plurality of load capacitors formed by conductor layers electrically connected to the assembly and each opposing via a dielectric layer, a first transmission line connected to any one of the central conductors, and a second transmission line magnetically coupled to the first transmission line, the conductor layers on the hot side and the ground side for the plural load capacitors being divided for every load capacitor.

This non-reciprocal circuit module exhibits the same effects as the first non-reciprocal circuit module, and has low loss with the conductor layers on the hot side and the ground side for the plural load capacitors divided for every load capacitor, thereby preventing the inductance parasitic to the load capacitors and equivalent series resistance from increasing to keep the load capacitor at a high Q value (low loss).

The laminate has a pore for receiving the assembly substantially at center. This pore may be a through-hole or a recess.

The third non-reciprocal circuit module of the present invention comprises (a) a permanent magnet for applying a DC magnetic field to a plate-shaped magnetic body, (b) an assembly comprising a central conductor member having central conductors extending from a ground electrode formed by a thin copper plate radially in a plurality of directions, and the magnetic body, the central conductors encircling the magnetic body in a mutually insulated manner and crossing substantially at the center of the magnetic body, and (c) a laminate constituted by a plurality of dielectric layers having conductor layers and having a pore for receiving the assembly substantially at center, the laminate comprising a plurality of load capacitors each formed by conductor layers opposing via the dielectric layer around the pore, a first transmission line connected to any one of the central conductors, and a second transmission line magnetically coupled to the first transmission line, the load capacitors being electrically connected to the assembly, such that one of the load capacitors is electrically connected to the first transmission line via the central conductor, while the other load capacitors are not connected to the first transmission line.

In addition to the above effects, such a structure makes it possible to separately confirm the electric characteristics of the non-reciprocal circuit and the directional coupler. Accordingly, when electric troubles take place in the non-reciprocal circuit module, it is possible to easily identify which functioning parts are culprits.

In the non-reciprocal circuit module of the present invention, it is preferable that an electrostatic capacitor is connected to at least one end of the first transmission line in parallel with the load capacitor to constitute the low-pass filter. It is also preferable that an electrostatic capacitor is connected in parallel to the first transmission line to constitute a parallel resonance circuit, and that an attenuation pole is provided at a resonance frequency of the parallel resonance circuit. Thus, by integrating the low-pass filter with the directional coupler, the number of circuit elements can be reduced than when the low-pass filter and the directional coupler are separately connected, thereby achieving the miniaturization of the overall high-frequency circuit with low loss as a whole because the insertion loss is caused only by the directional coupler.

In the present invention, each load capacitor is preferably constituted by conductor layers opposing via a dielectric layer in a lamination direction, part of the conductor layers being formed on a main surface of the laminate opposing to the permanent magnet. With such a structure, even with deviated center frequency of the non-reciprocal circuit, the capacitance can be controlled by trimming part of the conductor layers.

In the present invention, the first and second transmission lines constituting the directional coupler are opposing via a dielectric layer in a lamination direction. Such a structure needs smaller planar area than when the directional coupler is constituted by placing two transmission lines on the same plane. Further, winding the transmission line in a coil shape can preferably prevent the variation of coupling by positional deviation at the time of lamination.

The first and/or second transmission line may be constituted by electrically connecting a plurality of conductor layers formed on the different dielectric layers via through-holes. The coupling of the directional coupler can be controlled by adjusting the overlapping area of the conductor layers for the first and second transmission lines opposing via a dielectric layer in a lamination direction.

Provided on a rear surface of the laminate used in the non-reciprocal circuit module of the present invention is a wide ground electrode formed by a conductor layer, and the ground electrode serves as a common ground for the first and second transmission lines and the load capacitors. With such a structure, the ground potential of the laminate can easily be taken with sufficient bonding strength by soldering.

In the laminate according to one preferred embodiment of the present invention, to prevent interference between the first and second t transmission lines and the non-reciprocal circuit, conductor layers constituting the first and second transmission lines are formed in a first laminate region, while a plurality of load capacitors constituting the non-reciprocal circuit are formed in a second laminate region different from the first laminate region.

To prevent interference, the first and second transmission lines may be placed such that they do not overlap conductor layers constituting the load capacitor in a lamination direction, or the first laminate region may be separated from the second laminate region by the ground electrode.

In the present invention, the high-frequency amplifier can be mounted onto the laminate. The output terminal of the high-frequency amplifier is connected to one end of the first transmission line by conductor layers in the laminate. The high-frequency amplifier comprises an amplifier circuit having a transistor, an input-matching circuit connected to the input terminal of the amplifier circuit, and an output-matching circuit connected to the output terminal of the amplifier circuit, the input-matching circuit and the output-matching circuit each having a capacitor and an inductor. It is preferable that the transistor of the amplifier circuit is mounted onto the laminate, while the inductor is formed as a transmission line in the laminate. The capacitor is preferably formed by capacitor electrodes opposing via a dielectric layer in the laminate. The transistor of the amplifier circuit is preferably a field effect transistor, and the high-frequency amplifier is preferably constituted by a transistor made of gallium arsenide GaAs, these parts being mounted onto the laminate.

The characteristic impedance of the non-reciprocal circuit is set at 50Ω, while the input/output impedance of the transistor is about several Ω to several tens of Ω, needing input/output-matching circuits for connection therebetween. However, when a low-pass filter is used as an output-matching circuit connected to the output terminal of the amplifier circuit as shown in the equivalent circuit of FIG. 17, the number of circuit elements can be reduced as compared with when the output-matching circuit is mounted separately, resulting in improvement in the insertion loss characteristics.

BRIEF DESCRIPTION OF THE DRAWINGS

FIG. 4(*b*) is a graph showing the coupling characteristics of the non-reciprocal circuit module in Example 1;

FIG. 4(*c*) is a graph showing the isolation characteristics of the non-reciprocal circuit module in Example 1;

FIG. 7(*b*) is a graph showing the coupling characteristics of the non-reciprocal circuit module in Example 2;

FIG. 7(*c*) is a graph showing the isolation characteristics of the non-reciprocal circuit module in Example 2;

THE BEST MODE FOR CARRYING OUT THE INVENTION

Referring to the attached drawings, the specific structure of the non-reciprocal circuit module of the present invention will be explained below.

Figure 1:
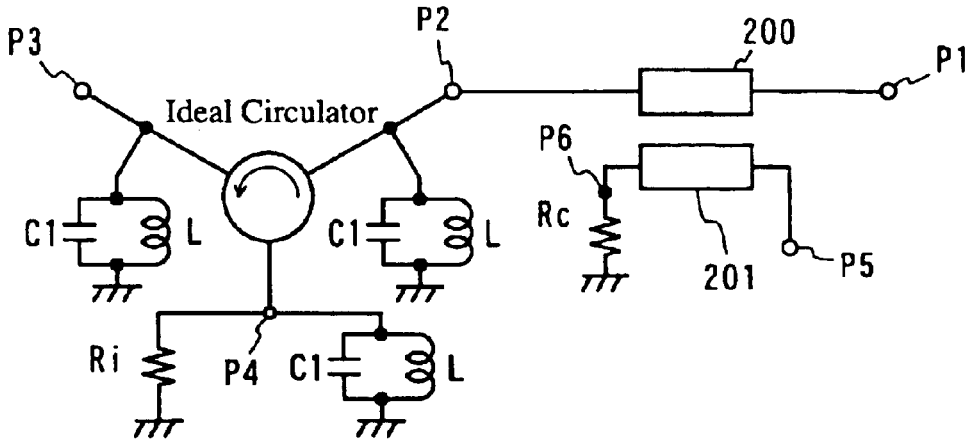
FIG. 1 is a view showing an equivalent circuit of the non-reciprocal circuit module according to one embodiment of the present invention.
Figure 2:
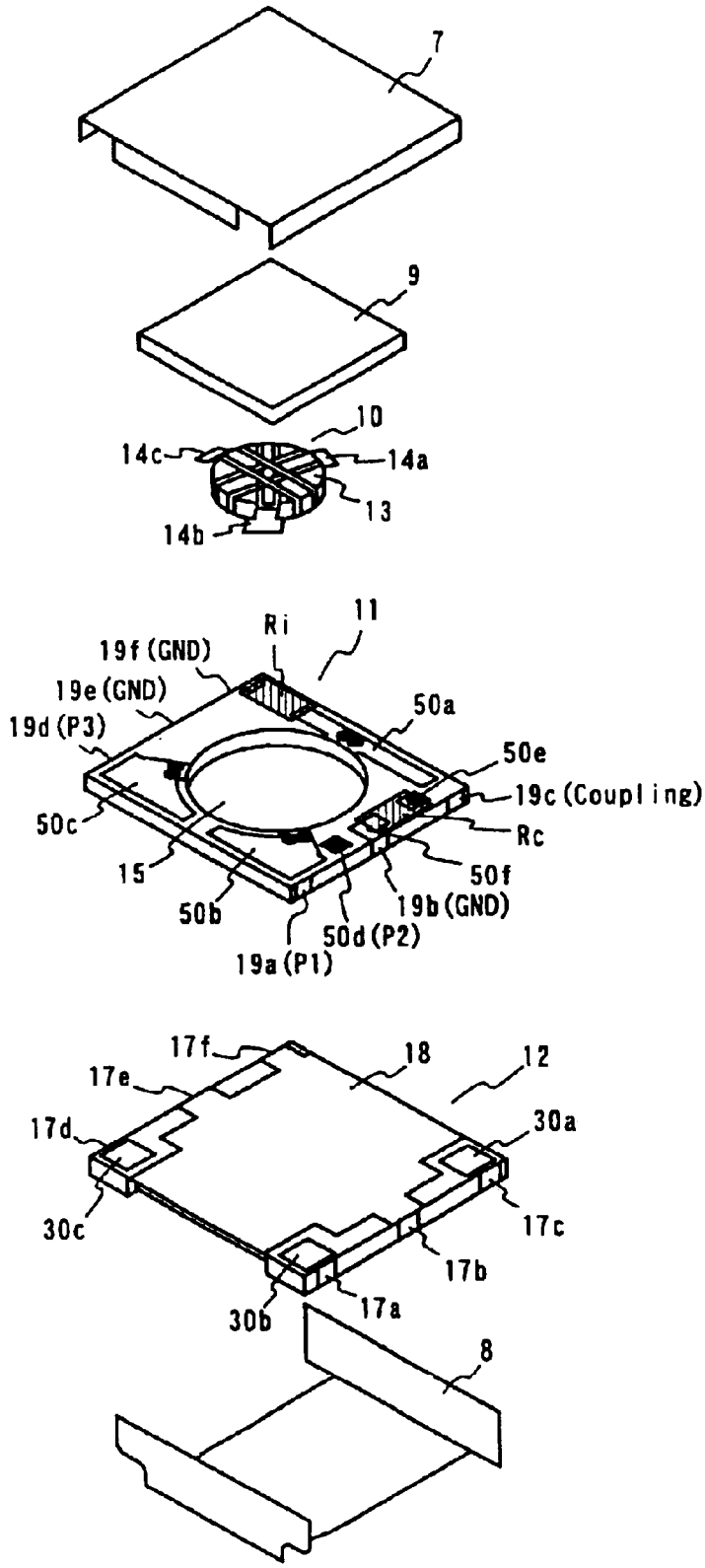
FIG. 2 is an exploded perspective view showing the non-reciprocal circuit module according to one embodiment of the present invention.
Figure 3:
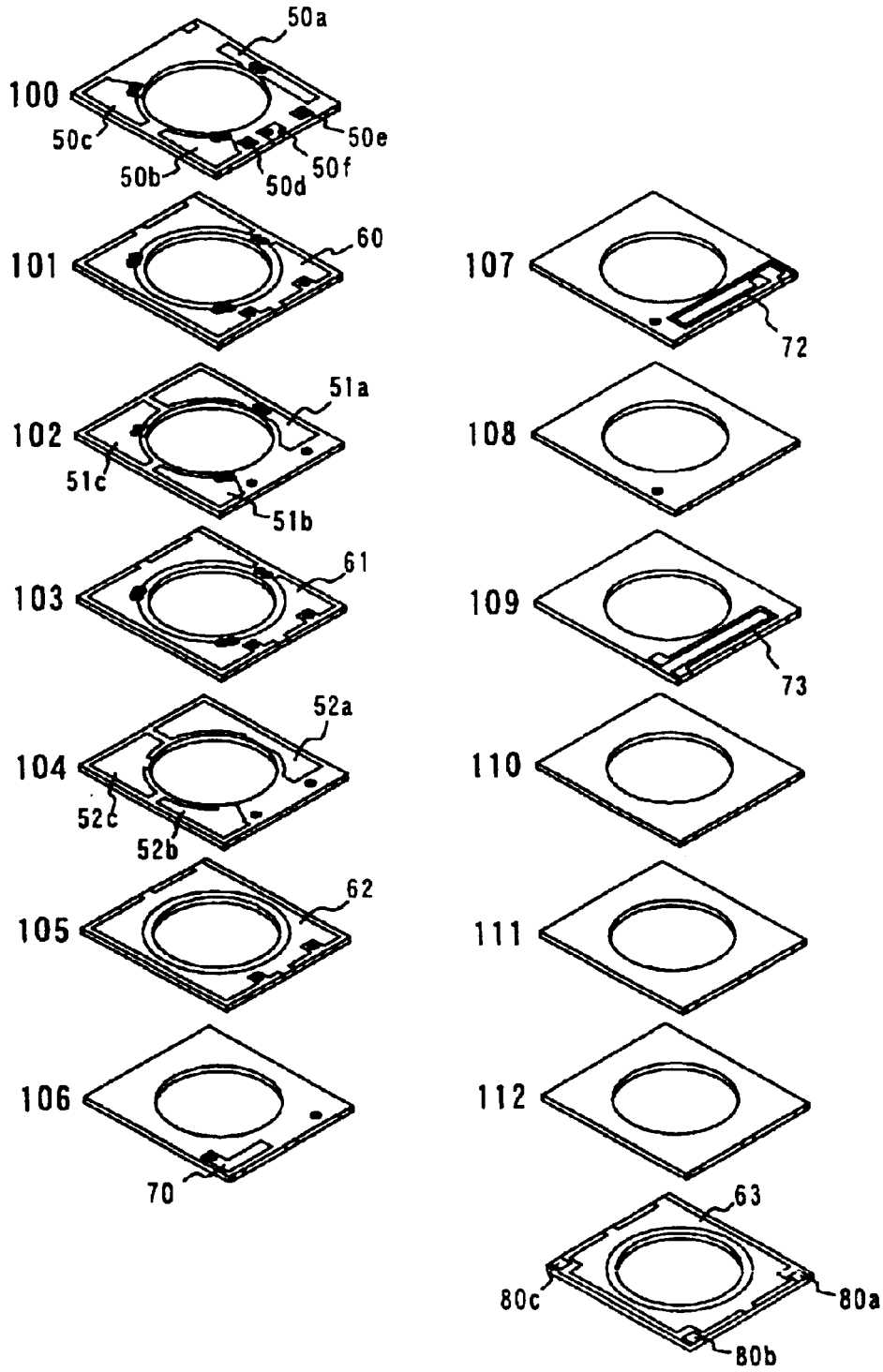
FIG. 3 is a development view showing the circuit structure of each layer constituting the laminate of the non-reciprocal circuit module of the present invention.

FIG. 1 shows an equivalent circuit of the non-reciprocal circuit module according to one embodiment of the present invention, FIG. 2 shows the non-reciprocal circuit module according to one embodiment of the present invention, and FIG. 3 shows the circuit structure of each layer constituting the laminate of the non-reciprocal circuit module of the present invention. This non-reciprocal circuit module is provided with the functions of a non-reciprocal circuit and a directional coupler, and operated at the desired impedance $Z_0$ with an external magnetic field applied from a permanent magnet 9 to a magnetic body 13 in the non-reciprocal circuit portion.

In FIG. 1, load capacitors C1 connected between terminals P2, P3, P4 and a ground GND determine the operation frequency of the non-reciprocal circuit. The inductance L of the magnetic body 13 encircled by central conductors 14*a*, 14*b* and 14*c* varies by an external magnetic field from the permanent magnet 9. To operate this non-reciprocal circuit as an isolator, a resistor Ri is connected between the terminal P4 and the ground. A directional coupler is constituted by a first transmission line 200 placed between the terminal P2 and the terminal P1, and a second transmission line 201 opposing the first transmission line 200 with magnetic coupling and having a terminal P6 connected to a resistor Rc.

The load capacitors C1 and the first and second transmission lines 200, 201 are formed as laminate constituents by conductor layers placed in the laminate 11 on a resin base 12, and resistors Ri, Rc constituted by printed resistors, chip resistor elements, etc. are placed on the laminate 11.

The laminate 11 is made of a low-temperature-sinterable, dielectric ceramic material, for instance, a dielectric material having a specific dielectric constant $\in r$ of about 8 and sinterable at 900° C. The laminate 11 may be produced, for instance, by forming green sheets each having a thickness of 30–100 $\mu$m by a doctor blade method, printing each green sheet with a conductive paste based on a conductor such as Ag, Cu, etc. to form the first and second transmission lines 200, 201 for the directional coupler and electrodes (conductor layers) for constituting load capacitors for the non-reciprocal circuit, integrally transmission a plurality of conductor-printed green sheets, and sintering the resultant laminate.

An assembly 10 comprises a central conductor member comprising three central conductors 14*a*, 14*b*, 14*c* integrally radially extending from a ground electrode formed by, for instance, a thin copper plate, and a magnetic body 13 such as a disc-shaped garnet, etc. placed on the ground electrode of the central conductor member. The central conductors 14*a*, 14*b*, 14*c* are bent along a side surface of the disc-shaped magnetic body 13, and overlapped each other at a distance of 120° in a mutually insulated manner via an insulating film, etc. The assembly 10 is placed in a center pore 15 of the laminate 11. One end of the central conductor 14*a* is connected to an electrode 50*a* for constituting a load capacitor on an upper surface of the laminate 11, and a central conductor 14*b* is connected to an electrode 50*b*. One end of the central conductor is connected to an electrode 50*c* on an upper surface of the laminate 11, and the other end of each central conductor is connected to a ground electrode (conductor plate) 18 on the resin base 12 via a ground electrode positioning on a lower surface of the disc-shaped magnetic body 13. The side surface of the resin base 12 is provided with a plurality of external terminals 17*a*–17*f* for connecting to a mounting board.

Figure 15:
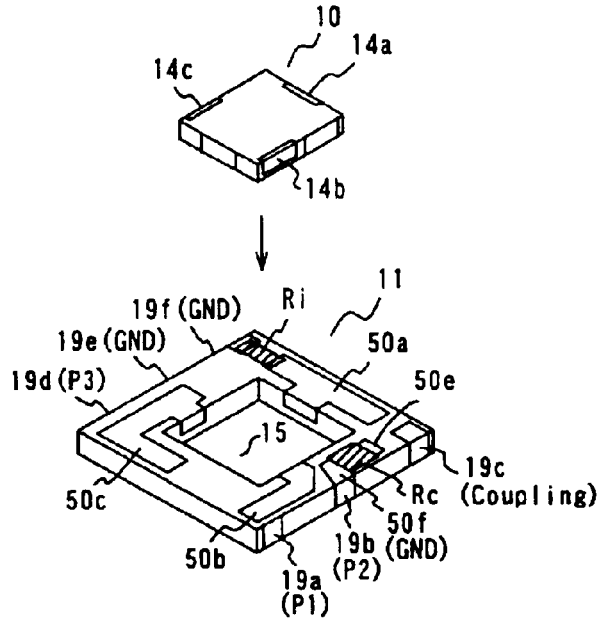
FIG. 15 is a perspective view showing another example of the assembly of the non-reciprocal circuit module of the present invention.
Figure 16:
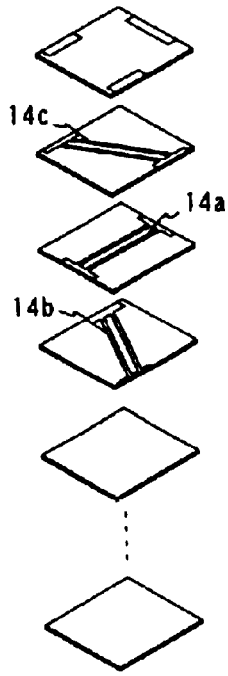
FIG. 16 is a development view showing the circuit structure of each layer constituting the assembly of the non-reciprocal circuit module of the present invention.
Figure 17:
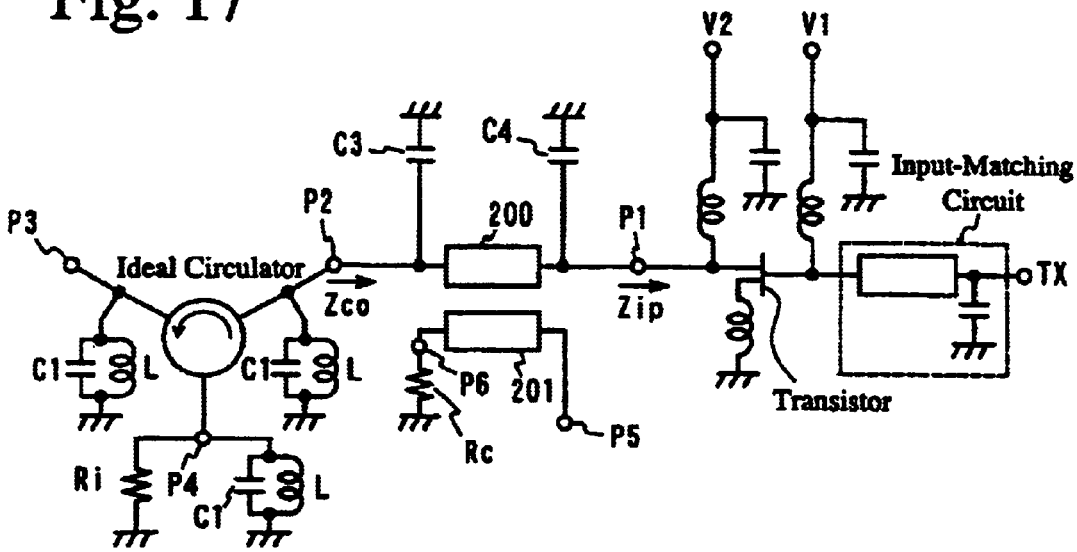
FIG. 17 is a view showing an equivalent circuit of the non-reciprocal circuit module according to a further embodiment of the present invention.
Figure 18:
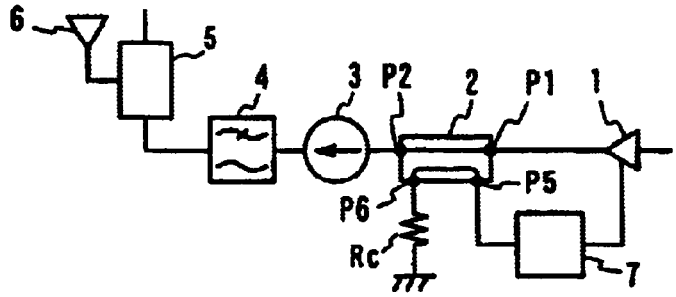
Fig. 18 (PRIOR ART)
FIG. 18 is a block diagram showing a transmitting circuit means of the mobile phone.
Figure 19:
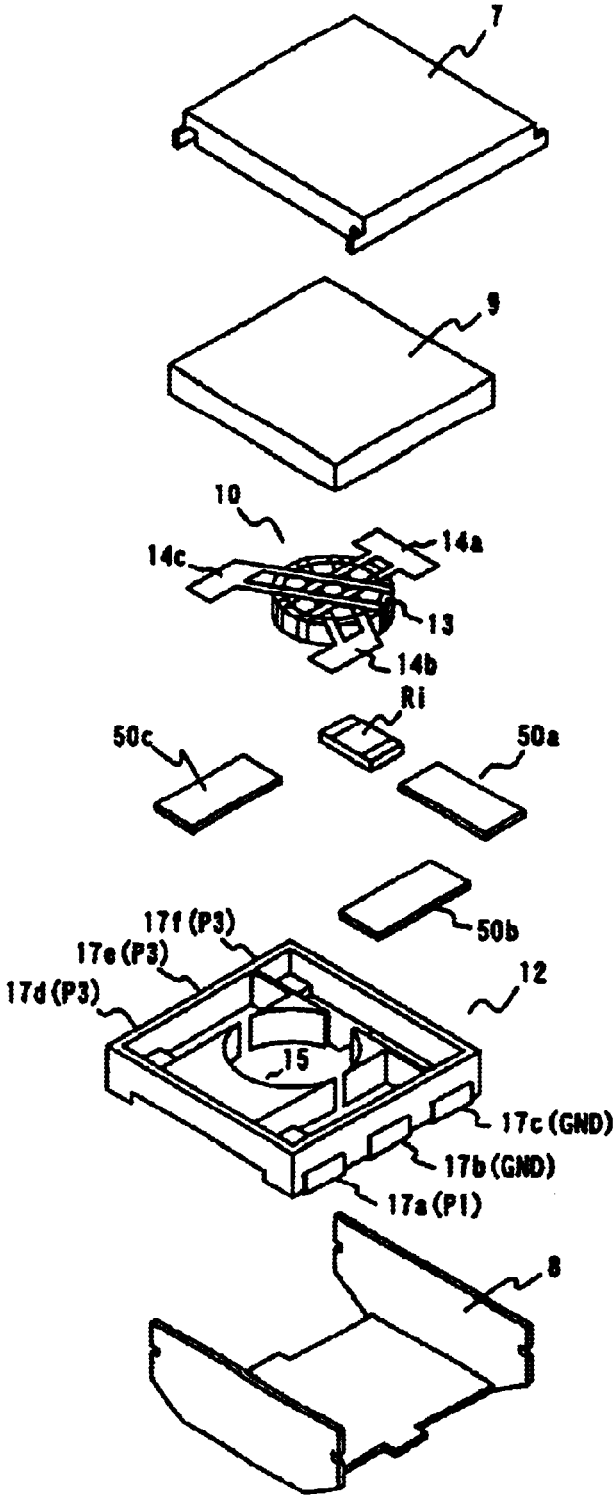
Fig. 19 (PRIOR ART)
FIG. 19 is an exploded perspective view showing a conventional non-reciprocal circuit device.

The assembly 10 can be produced by other methods than the above one. For instance, as shown in FIGS. 15 and 16, a sheet-shaped magnetic body may be formed by a sheet-forming technology such as a doctor blade method, etc., and formed with an electrode pattern for a central conductor and integrally laminated and then sintered. Also, a central conductor may be formed on a sintered magnetic body by a thin-film technology.

By disposing the assembly 10 in a pore 15 of the laminate 11, placing a magnet 9 for applying a DC magnetic field to the assembly 10 thereon, and vertically enclosing them by metal cases 7, 8 serving as magnetic yokes, the non-reciprocal circuit module of the present invention can be obtained.

EXAMPLE 1

One example of the internal structure of the laminate 11 will be explained in a lamination order referring to FIG. 3.

The laminate 11 is used for a non-reciprocal circuit module for W-CDMA (wideband CDMA, transmitted frequency TX: 1.92 GHz–1.98 GHz). For the simplicity of explanation, W-CDMA is taken as an example of a system for a wireless communications device, the same effects of the present invention can be obtained in the other systems.

First, the lowermost green sheet 112 is formed with a ground electrode 63 substantially on an entire rear surface, and then with electrodes 80*a*–80*c*, which are connected to connection electrodes 30*a*–30*c* formed on a resin base 12. After green sheets 111, 110 on which electrode patterns are not printed are laminated on the green sheet 112, a green sheet 109 provided with a line electrode 73 for constituting a first transmission line is laminated thereon. Laminated thereon are a green sheet 108 formed with a through-hole electrode (shown by a black circle in the figure), and then a green sheet 107 formed with a line electrode 72 for constituting the second transmission line and a through-hole electrode. One end of the line electrode 72 is connected to an external electrode 19*c* formed on the side surface of the laminate 11, and one end of the line electrode 73 is connected to an external electrode 19*a* formed on the side surface of the laminate 11.

A connection electrode 70 formed on the green sheet 106 has one end connected to a line electrode 73 via a through-hole electrode, and the other end connected to a pattern electrode 50*d* on an upper surface of the laminate 11 via through-hole electrodes of green sheets 100–105. A line electrode 72 is connected to a pattern electrode 50*e* on an upper surface of the laminate 11 via through-hole electrodes formed in the green sheets 100–106.

Laminated on the green sheet 106 are a green sheet 105 provided with a ground electrode 62 and through-hole electrodes, a green sheet 104 provided with electrode patterns 52*a*–52*c* for load capacitors and through-hole electrodes, a green sheet 103 provided with a ground electrode 61 and through-hole electrodes, a green sheet 102 provided with electrode patterns 51*a*–51*c* for load capacitors and through-hole electrodes, a green sheet 101 provided with a ground electrode 60 and through-hole electrodes, and a green sheet 100 provided with electrode patterns 50*a*–50*c* for load capacitors, connecting electrodes 50*d*50*f* and through-hole electrodes in this order.

Load capacitors C1 connected to terminals P3, P2 and P4, respectively are constituted by electrode patterns 50*b*, 51*b*, 52*b*, electrode patterns 50*c*, 51*c*, 52*c* and electrode patterns 50*a*, 51*a*, 52*a*, and ground electrodes 60, 61, 62.

Resistors Ri, Rc are formed on an upper surface of the laminate 11 by a printing/baking method. The resistor Ri is a terminal resistor for an isolator, and the resistor Rc is a terminal resistor for a directional coupler. In place of the printed resistors chip resistors may be used, and each resistor may be formed simultaneously with sintering the laminate.

Formed on a lower surface of the laminate 11 are input/output electrodes 80*a*, 80*b*, 80*c* connected to connection electrodes 30*a*, 30*b*, 30*c* of the resin base 12, and a ground electrode 63 connected to a ground electrode 18 of the resin base 12.

To achieve the good function of the directional coupler, it is important that inter-layer distances between a line electrode 73 as a main line and a ground electrode 63, and between a line electrode 72 as a sub-line and a ground electrode 62, and their line widths are properly set to maintain the characteristic impedance of lines at 50Ω. In this example, a dielectric material having a specific dielectric constant Er of about 8 is used to form the laminate 11, with a distance of 300 μm between the upper and lower ground electrodes sandwiching the line electrodes, each line electrode having a width of 100 μm and a line length of about 1/16 wavelength.

The line electrodes 72, 73 constituting the first and second transmission lines respectively have a one-turn-coil shape, opposing at a distance of 100 μm via a dielectric layer in a lamination direction to have the coupling of 20 dB. It is preferable that with a directional coupler having such a coil coupling structure, the coupling can easily be controlled by the layer distance between the main line and the sub-line and the line length of their overlapping portion. Of course, the line electrodes may be turned by one or more times depending on the shape of the laminate 11. In the laminate of this example, line electrodes for the directional coupler and electrodes for the load capacitors are formed on separate layers of the laminate with a ground electrode sandwiched therebetween to have decreased interference of these parts.

The first transmission line (line electrode 73) for the directional coupler and an electrode pattern 50*b* for the load capacitor are connected on an outer surface of the laminate 11, so that the electric characteristics of the non-reciprocal circuit and the directional coupler can separately be confirmed. This makes it possible to easily identify which functional parts are culprits when there are electric malfunctions in the non-reciprocal circuit. For instance, even if a center frequency deviates in the non-reciprocal circuit, such deviation can easily be found. In addition, if electrodes 50*a*, 50*b*, 50*c* for load capacitors formed on an outer surface of the laminate 11 are trimmed to adjust their capacitance, the center frequency can be varied.

Thus, the laminate 11 having an outer size of 4 mm×3.5 mm×0.5 mm was obtained. Using the laminate 11, an extremely small non-reciprocal circuit module having an equivalent circuit shown in FIG. 1, a structure shown in FIG. 2 and an outer size of 4 mm×4 mm×1.7 mm was produced.

Figure 4A:
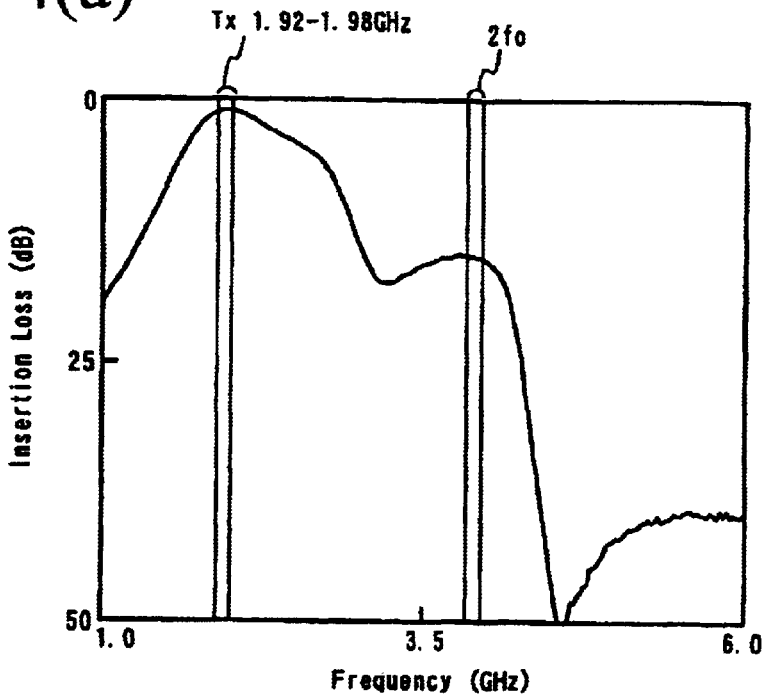
FIG. 4(*a*) is a graph showing the insertion loss characteristics of the non-reciprocal circuit module in Example 1.
Figure 4B:
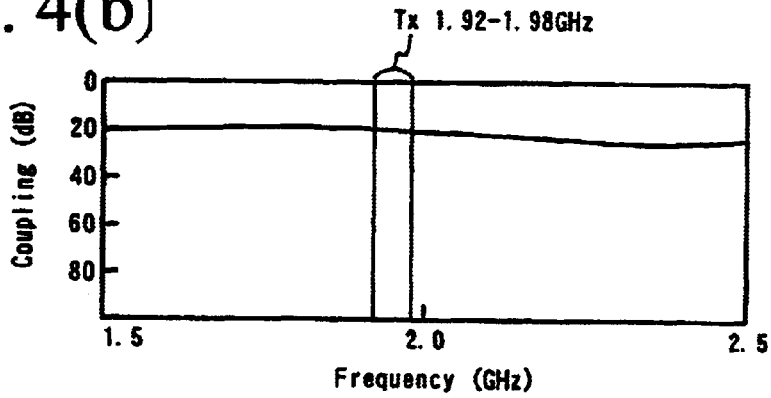
Figure 4C:
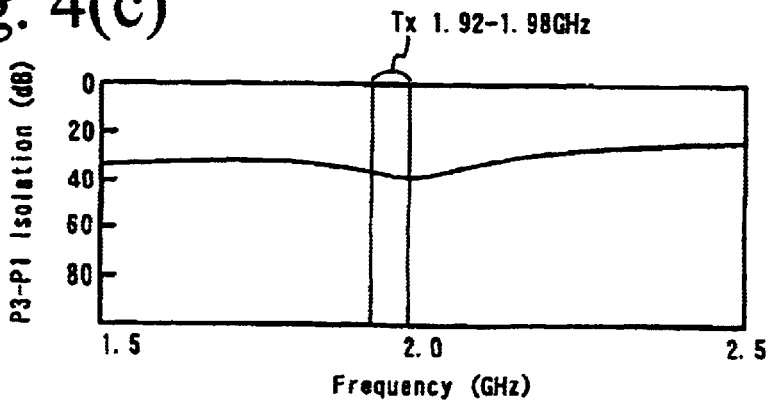

FIGS. 4(*a*)–(*c*) show the insertion loss characteristics and coupling characteristics (degree of coupling) of this non-reciprocal circuit module, as well as its isolation characteristics between the output terminal P3 and the input terminal P1. As is clear from FIGS. 4(*a*)–(*c*), the non-reciprocal circuit module of this example has excellent insertion loss characteristics, coupling characteristics and isolation characteristics in a desired frequency band with directivity of 18 dB or more. This indicates that the non-reciprocal circuit module of this example is fully small and high in performance.

EXAMPLE 2

Figure 5:
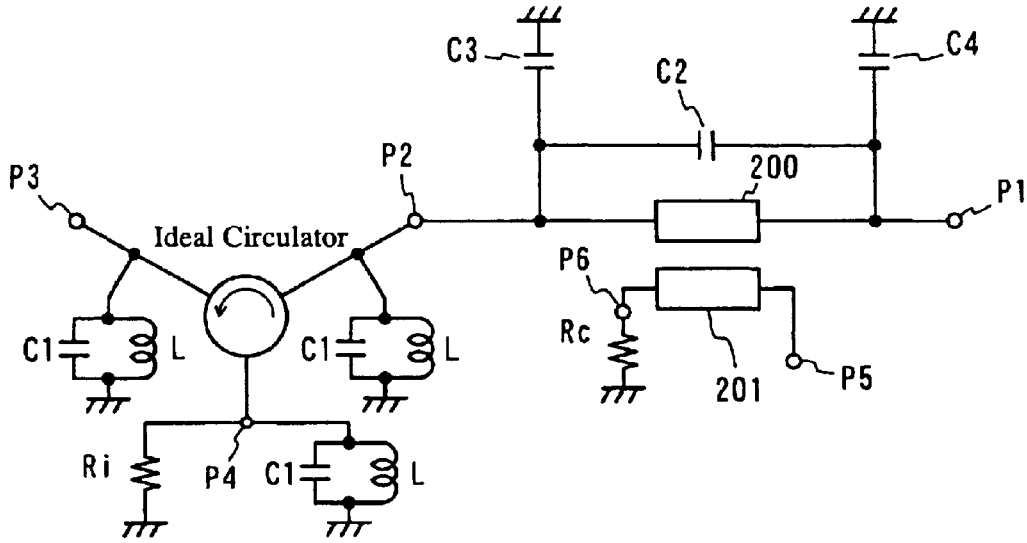
FIG. 5 is a view showing an equivalent circuit of the non-reciprocal circuit module according to another embodiment of the present invention.

FIG. 5 shows an equivalent circuit of the non-reciprocal circuit module according to another embodiment of the present invention. This non-reciprocal circuit module is provided with the function of a directional coupler as well as the function of a low-pass filter.

Because the non-reciprocal circuit module of this example has the same portions as those of Example 1, only different portions are explained here. The differences from Example 1 are; (1) the first and second electrostatic capacitors C3, C4 are connected between both ends of the first transmission line and the ground to constitute a low-pass filter by the first transmission line and the first and second electrostatic capacitors C3, C4, and (2) the third electrostatic capacitor C2 is connected in parallel to the first transmission line to have sharp attenuation.

Figure 6:
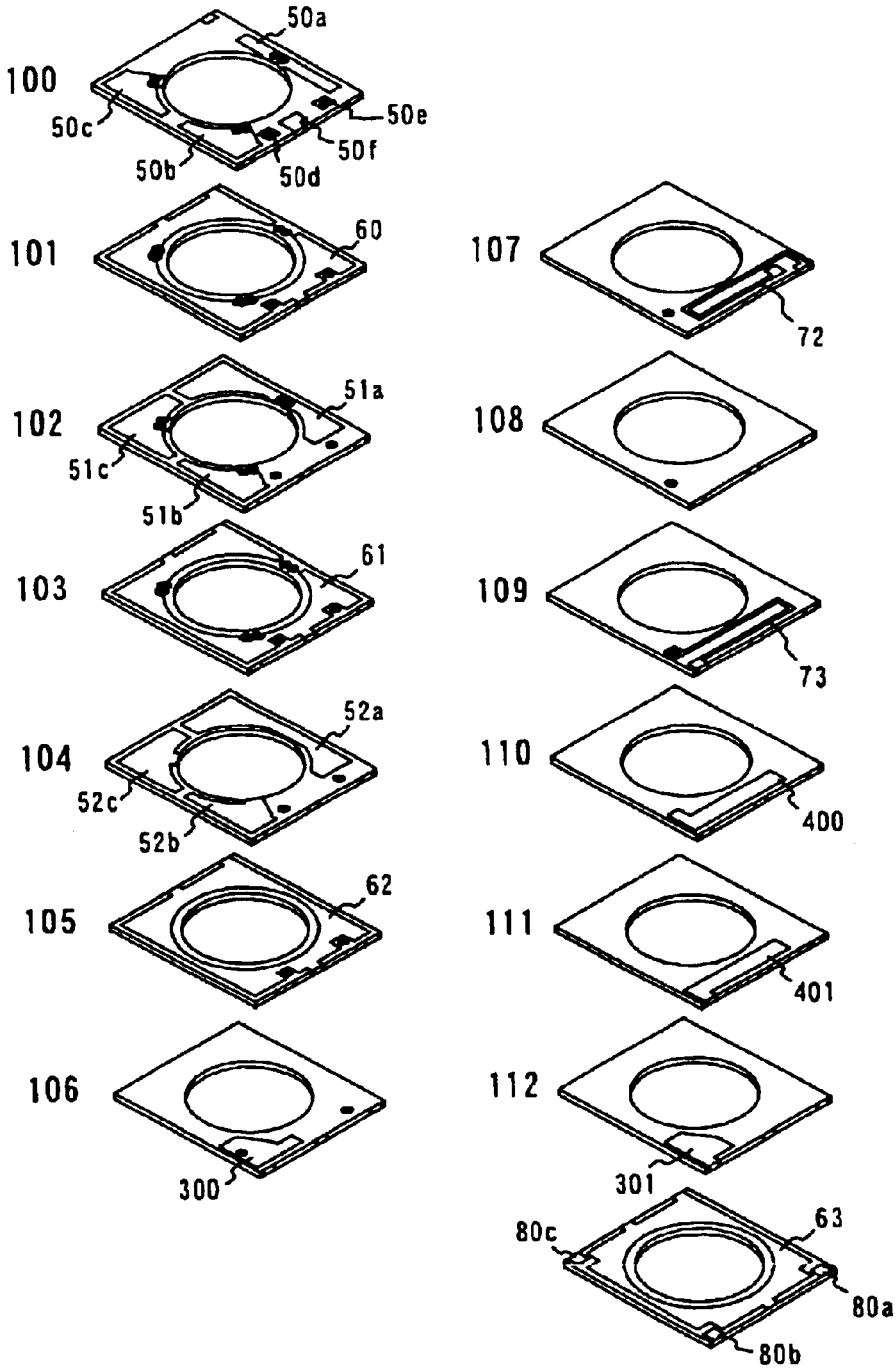
FIG. 6 is a development view showing another circuit structure of each layer constituting the laminate of the non-reciprocal circuit module of the present invention.

FIG. 6 is an exploded perspective view showing the laminate 11 of this example. The differences from Example 1 are that an electrode 300 for an electrostatic capacitor C3 is formed on the green sheet 106, that an electrode 400 for an electrostatic capacitor C2 is formed on the green sheet 110, that an electrode 401 for an electrostatic capacitor C2 is formed on the green sheet 111, and that an electrode 301 for an electrostatic capacitor C4 is formed on the green sheet 112. With such a structure, the first transmission line 200 can be utilized as an inductor for the low-pass filter, but also the non-reciprocal circuit module can be made multi-functional while maintaining the insertion loss and the size at the same level as Example 1 as compared with when the low-pass filter is simply added to the non-reciprocal circuit module of Example 1. Accordingly further reduction of the number of parts and decrease in the mounting area can be achieved.

Figure 8:
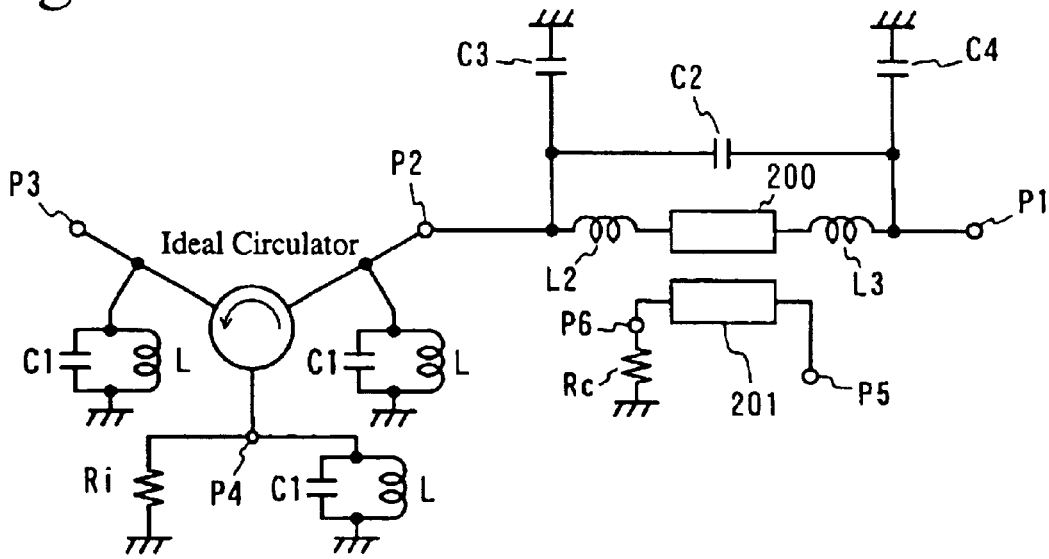
FIG. 8 is a view showing an equivalent circuit of the non-reciprocal circuit module according to a further embodiment of the present invention.

When the first transmission line 200 fails to provide sufficient inductance as a low-pass filter, the line electrode 73 constituting the first transmission line 200 needs only be elongated properly while keeping the opposing relation with the second transmission line 201 to provide the first distributed constant line 200 with inductance as shown in FIG. 8.

Figure 7A:
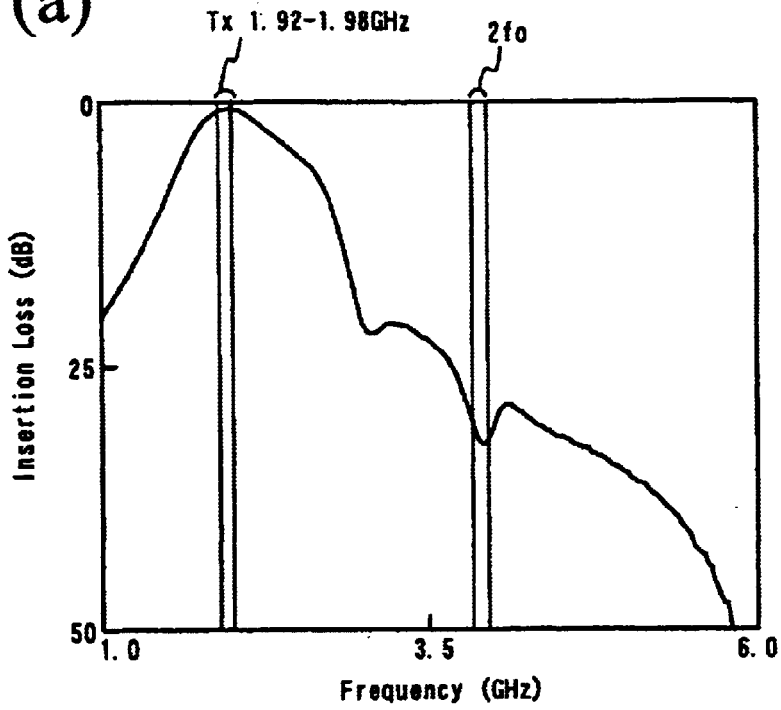
FIG. 7(*a*) is a graph showing the insertion loss characteristics of the non-reciprocal circuit module in Example 2.
Figure 7B:
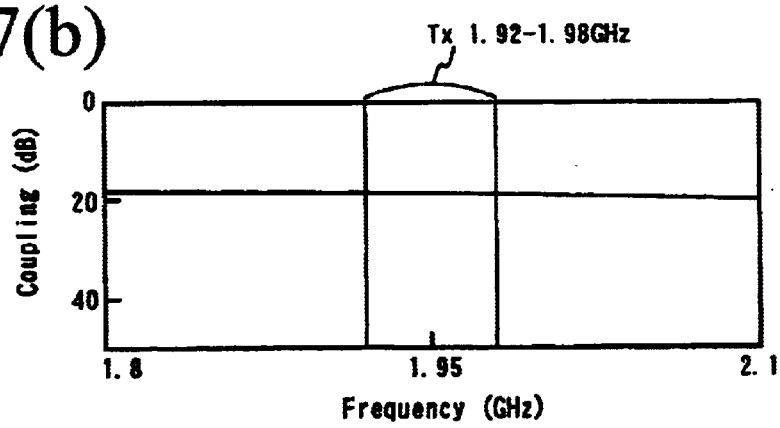
Figure 7C:
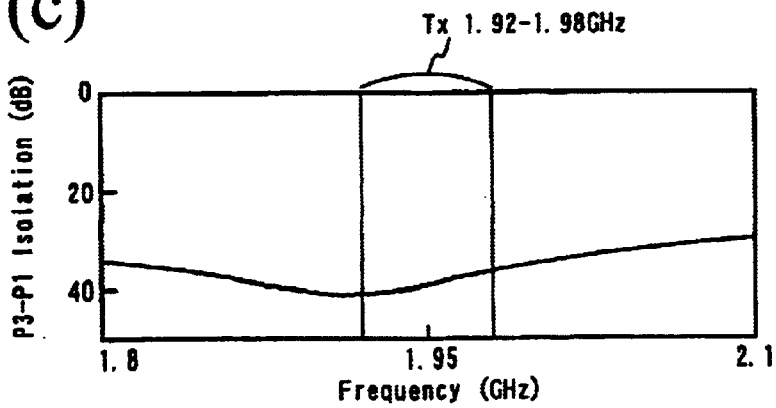

FIGS. 7(*a*)–(*c*) show the insertion loss characteristics and coupling characteristics of this non-reciprocal circuit module as well as its isolation characteristics between the output terminal P3 and the input terminal P1. As is clear from FIGS. 7(*a*)–(*c*), excellent insertion loss characteristics, coupling characteristics and isolation characteristics are obtained in the desired frequency band, and the second harmonic attenuation is 30 dB or more with directivity of 19 dB or more. This indicates that the non-reciprocal circuit module of this example is sufficiently small and high in performance.

EXAMPLE 3

Though Examples 1, 2 are directed to the non-reciprocal circuit module for W-CDMA, this example is directed to a non-reciprocal circuit module for D-AMPS (digital-advanced mobile phone service, transmitted frequency TX: 824 MHz-849 MHz).

Figure 9:
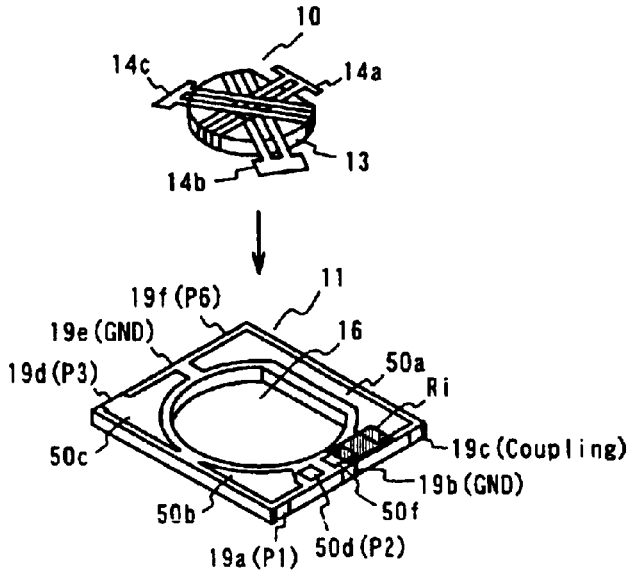
FIG. 9 is a perspective view showing another example of the laminate of the non-reciprocal circuit module of the present invention.

In general, as a frequency handled decreases, any of the inductance, load capacitance and line length of a directional coupler should be increased, resulting in difficulty in the miniaturization. Thus, part of a circular pore 16 of the laminate 11 in this example is buried as shown in FIG. 9. This provides advantages of increasing the area of an electrode pattern on the green sheet and the capacitance of the load capacitor C1, thereby stabilizing the ground. Therefore, the magnetic body 13 has a deformed circular shape of 2.5 mm in diameter partially cut by 0.75 mm from a periphery in this Example.

Figure 10:
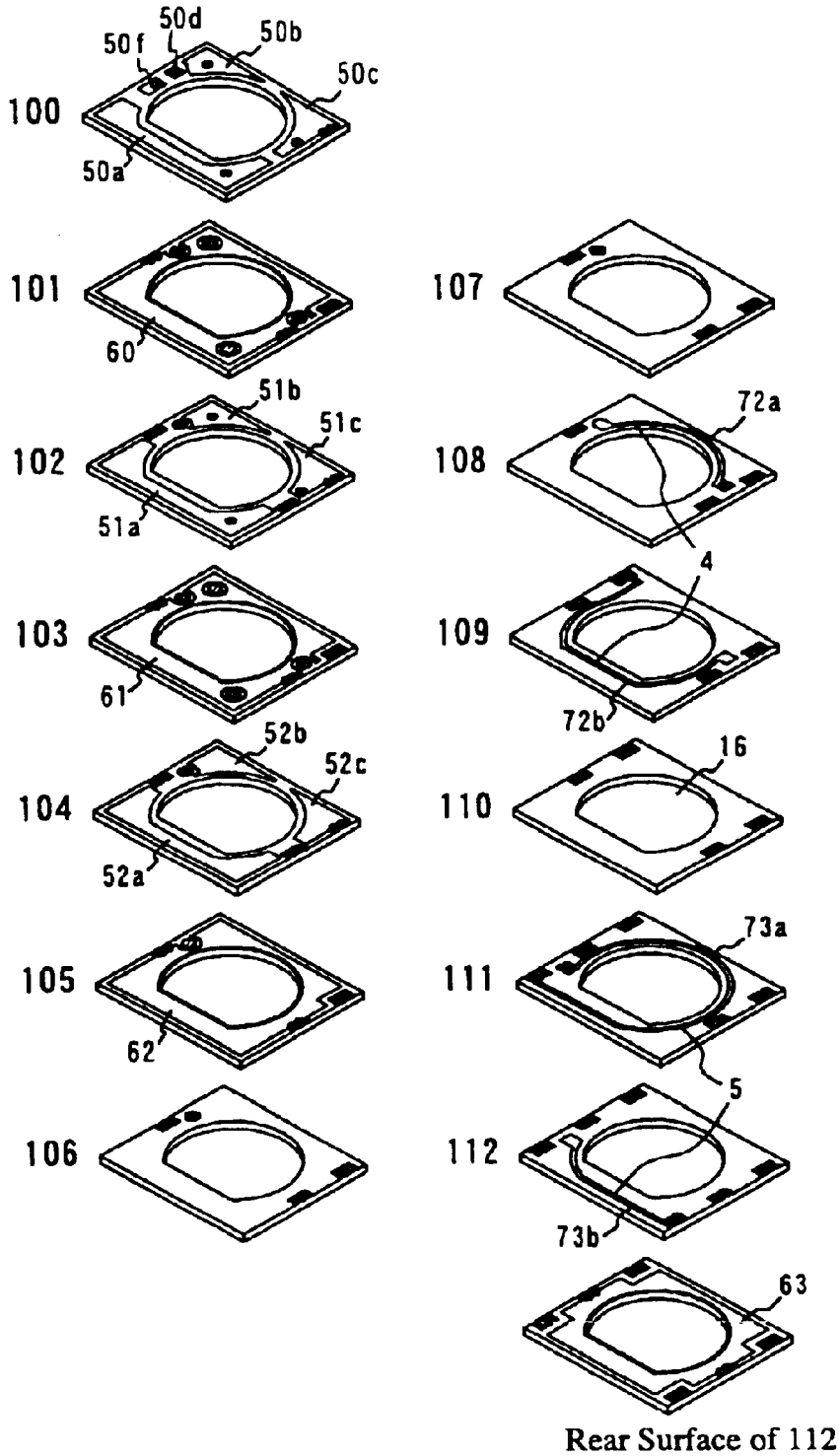
FIG. 10 is a development view showing a further circuit structure of each layer constituting the laminate of the non-reciprocal circuit module of the present invention.

The internal structure of the laminate 11 is explained in a lamination order referring to FIG. 10. The lowermost green sheet 112 is provided with a ground electrode 63 and a pattern electrode connected to a connection electrode formed on the resin base 12 substantially on an entire rear surface. One line electrode 73*b* constituting the second transmission line is formed on the green sheet 112. A green sheet 111 formed with another line electrode 73*a* constituting the second transmission line is laminated on the green sheet 12. The green sheet 111 is provided with a through-hole electrode, through which the line electrode 73*a* is connected to the line electrode 73*b*, thereby constituting a second transmission line in a one-turn shape.

Laminated on the green sheet 111 are a green sheet 110 on which an electrode pattern is not printed, and a green sheet 109 formed with a line electrode 72*b* constituting the first transmission line. A green sheet 108 formed with another line electrode 72*a* constituting the first transmission line is laminated on the green sheet 109. The green sheet 108 is provided with a through-hole electrode, through which the line electrode 72*a* is connected to the line electrode 72*b*, thereby constituting a first transmission line in a one-turn shape. One end of this first transmission line extends to a pattern electrode 50*d* on an upper surface of the laminate 11 through the through-hole electrodes formed in the green sheets 100–107.

Laminated on the green sheet 108 are green sheets 107 and 106 both provided with through-hole electrodes, a green sheet 105 provided with a ground electrode 62 and through-hole electrodes, a green sheet 104 provided with electrode patterns 52*a*–52*c* for load capacitors and through-hole electrodes, a green sheet 103 provided with a ground electrode 61 and through-hole electrodes, a green sheet 102 provided with electrode patterns 51*a*–51*c* for load capacitors and through-hole electrodes, a green sheet 101 provided with a ground electrode 60 and through-hole electrodes, and a green sheet 100 provided with electrode patterns 50*a*–50*c* for load capacitors, connecting pattern electrodes 50*d*, 50*f* and through-hole electrodes in this order.

Load capacitors C1 connected to terminals P2, P3 and P4 are constituted by electrode patterns 50*b*, 51*b*, 52*b*, electrode patterns 50*c*, 51*c*, 52*c* and electrode patterns 50*a*, 51*a*, 52*a*, and ground electrode patterns 60, is 61, 62.

A resistor Ri is formed as a terminal resistor for an isolator on an upper surface of the laminate 8 by a printing/baking method. A chip resistor may be used in place of the printed resistor, and the resistor Ri may be formed by simultaneously with sintering the laminate.

Thus obtained is a laminate 11 having an outer size of 4 mm×3.5 mm×0.5 mm. In this example, the first transmission line and the second transmission line are placed such that they enclose a pore 16. With such a structure, relatively long lines can be formed in a restricted region in the laminate 11. It has thus been found that a distributed constant line can be formed with a line length with only small unevenness in the degree of coupling in a frequency band of a transmitting signal, and that directivity, one of the important characteristics of the directional coupler, is 10 dB or more.

In this example, a dielectric body having a specific dielectric constant $\in r$ of about 8 is used to constitute the laminate 11, with a distance of 400 $\mu$m between the ground electrodes 62, 63 sandwiching the first and second transmission lines, each line electrode having a width of 100 $\mu$m, and the first and second transmission lines having a line length of about 1/12 wavelength. Also, the first and second transmission 200, 201 are each in a one-turn coil type, and the closest electrode patterns 72*b*, 73*a* among those for the first and second distributed constant lines opposing via a dielectric layer oppose each other by a distance of 100 $\mu$m. Thus obtained is an extremely small non-reciprocal circuit module having the function of a directional coupler and an outer size of 4 mm×4 mm×1.7 mm.

With the above structure, the coupling of 14.3 dB has been achieved. Such a coil coupling structure is preferable, because the degree of coupling can easily be controlled by a layer distance between the main line and the sub-line and a line length of their overlapping portion. Of course, the line electrodes may be turned one or more times depending on the shape of the laminate 11.

EXAMPLE 4

Figure 12:
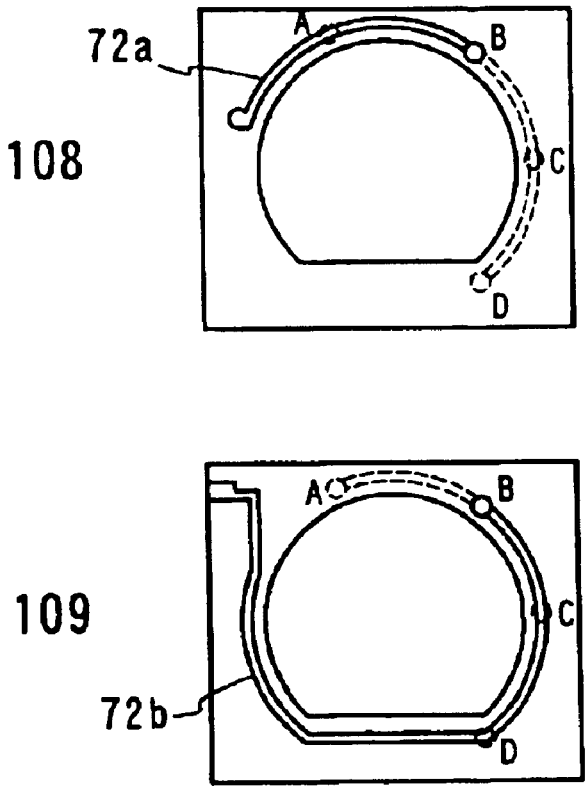
FIG. 12 is a development view showing the structure of the first transmission line for the explanation of control of the coupling of a directional coupler constituting the non-reciprocal circuit module of the present invention.

A further example of the non-reciprocal circuit module of the present invention is explained referring to FIG. 12. Because the non-reciprocal circuit module of this example has the same portions as those of the non-reciprocal circuit module of Example 3, only different portions will be explained for the simplicity of explanation. FIG. 12 is a plan view showing green sheets 108, 109 provided with line electrodes 72*a*, 72*b* for constituting the first transmission line 200.

The first transmission line 200 of this example has line electrodes 72*a*, 72*b* formed on two layers and connected via through-hole electrodes as in Example 3. With the positions of through-hole electrodes and the length of line electrodes 72*a*, 72*b* properly varied, an area was changed in the closest electrode patterns among those of the first and second transmission lines opposing via a dielectric layer. When the through-hole electrode is at a point A, B, C or D on the green sheet 108 shown in FIG. 12, it is in contact with a portion at the point A, B, C or D on the green sheet 109. Incidentally, a through-hole electrode is formed in a portion B in Example 3.

As a result of measuring the variation of the degree of coupling of the directional coupler by changing the position of the through-hole electrode, it has been found that the degree of coupling varies from 12.5 dB to 14.3 dB, 14.8 dB and 15.0 dB at each point A–D. Thus, the degree of coupling can easily be controlled only by adjusting the position of a through-hole in a plane.

Though the position of the through-hole electrode in the first transmission line 200 is changed to vary the degree of coupling in this example, the same effects are also obtained by changing the position of a through-hole electrode in the second transmission line 201 or the positions of through-hole electrodes in both first and second distributed constant lines. The directivity was 10 dB or more, on the same level as in Example 3.

EXAMPLE 5

Figure 11:
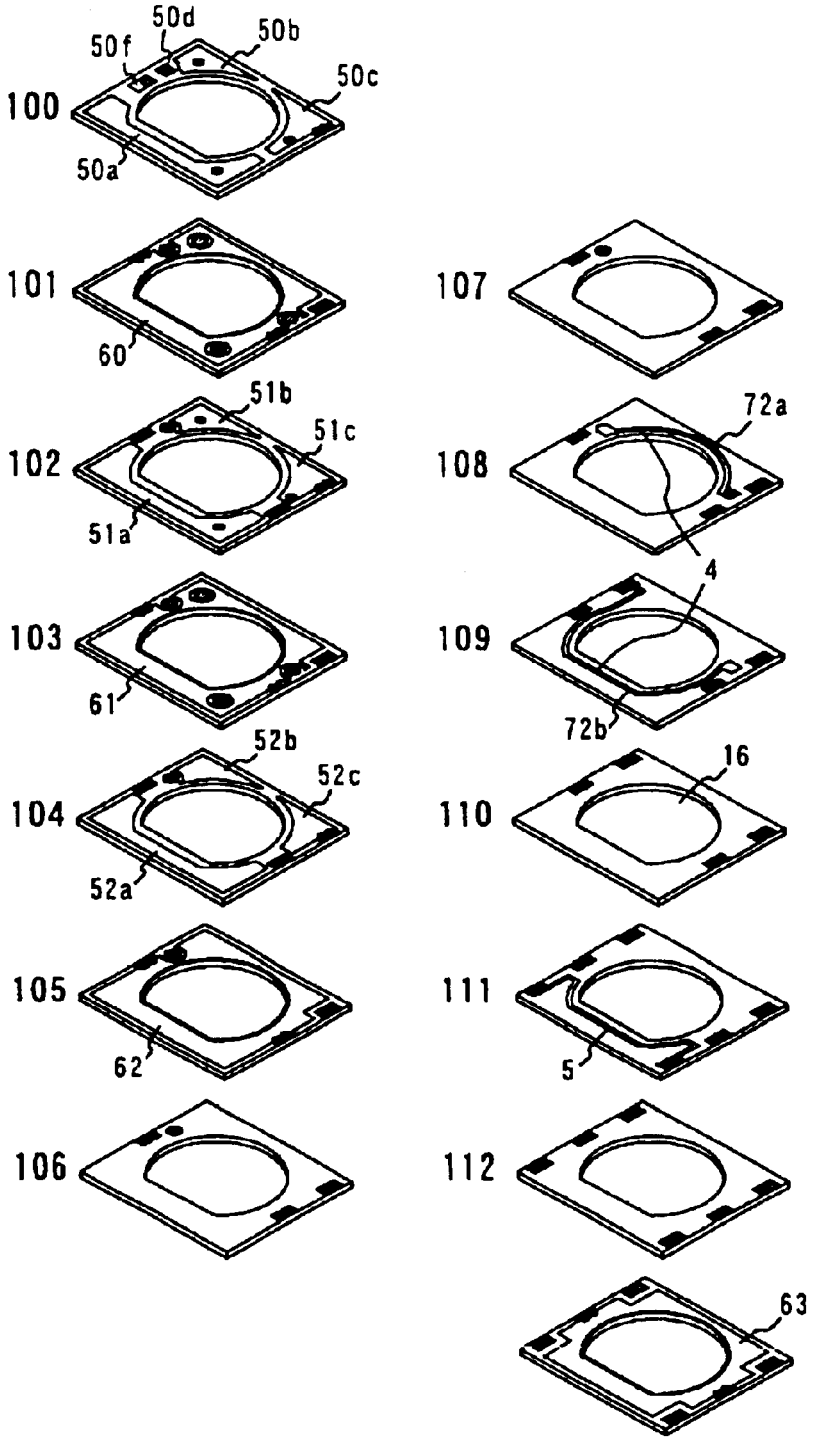
FIG. 11 is a development view showing a further circuit structure of each layer constituting the laminate of the non-reciprocal circuit module of the present invention.

A further example of the non-reciprocal circuit module according to the present invention is explained referring to FIG. 11. The non-reciprocal circuit module of this example has the same portions as those of the non-reciprocal circuit module of Example 3, only different portions will be explained for the simplicity of explanation. In the laminate shown in FIG. 11, the second transmission line 201 was short and formed only on the green sheet 111. With such a structure, the coupling could be decreased to as small as 20.7 dB, lower than in Example 3. The directivity was 10 dB or more, though it was poorer than in Example 1.

EXAMPLE 6

Figure 13:
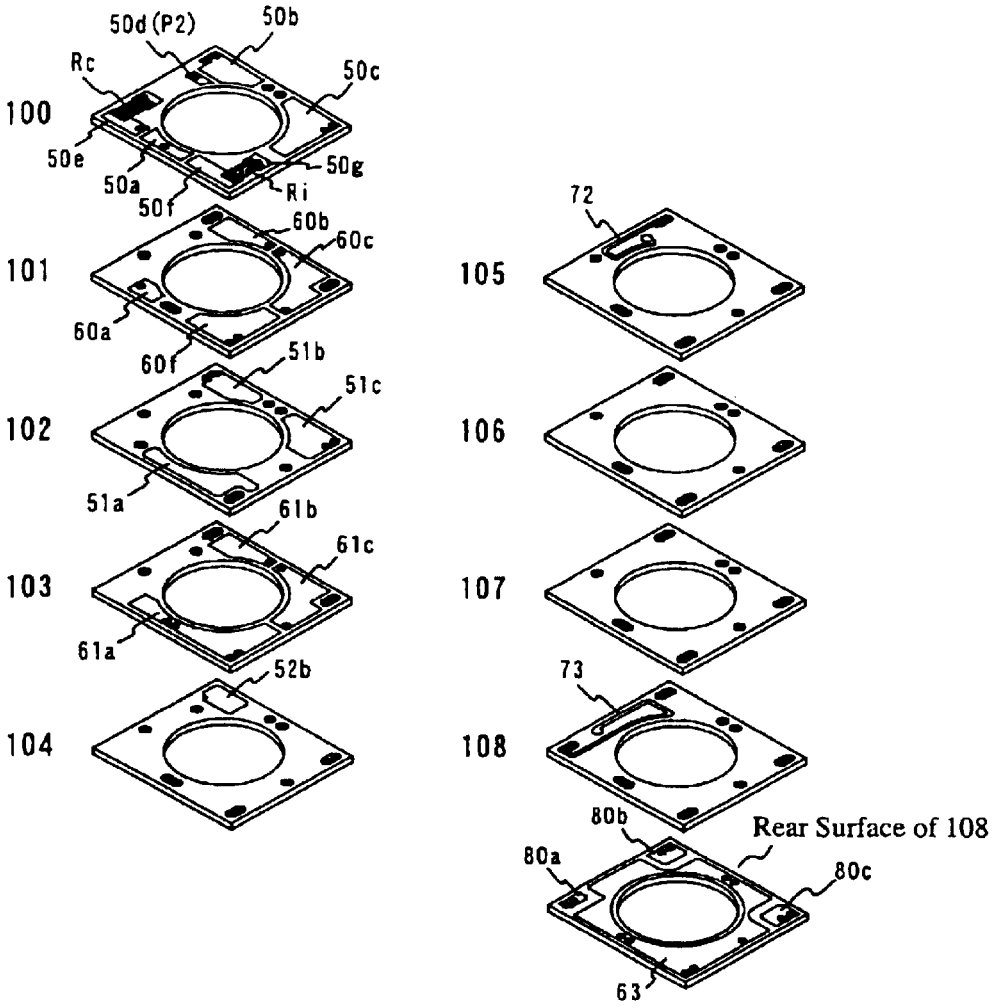
FIG. 13 is a development view showing a further circuit structure of each layer constituting the laminate of the non-reciprocal circuit module of the present invention.

A further example of the non-reciprocal circuit module according to the present invention is explained referring to FIG. 13. Because this example has the same portions as in the above Example, only different portions will be explained for the simplicity of explanation. In the example shown in FIG. 13, a ground electrode for constituting the load capacitors is divided for every load capacitors, the green sheet 101 is formed with ground electrodes 60*a*, 60*b*, 60*c*, and the green sheet 103 is formed with ground electrodes 61*a*, 61*b*, 61*c*. Thus, the load capacitor is constituted as a low-loss capacitor.

Figure 14:
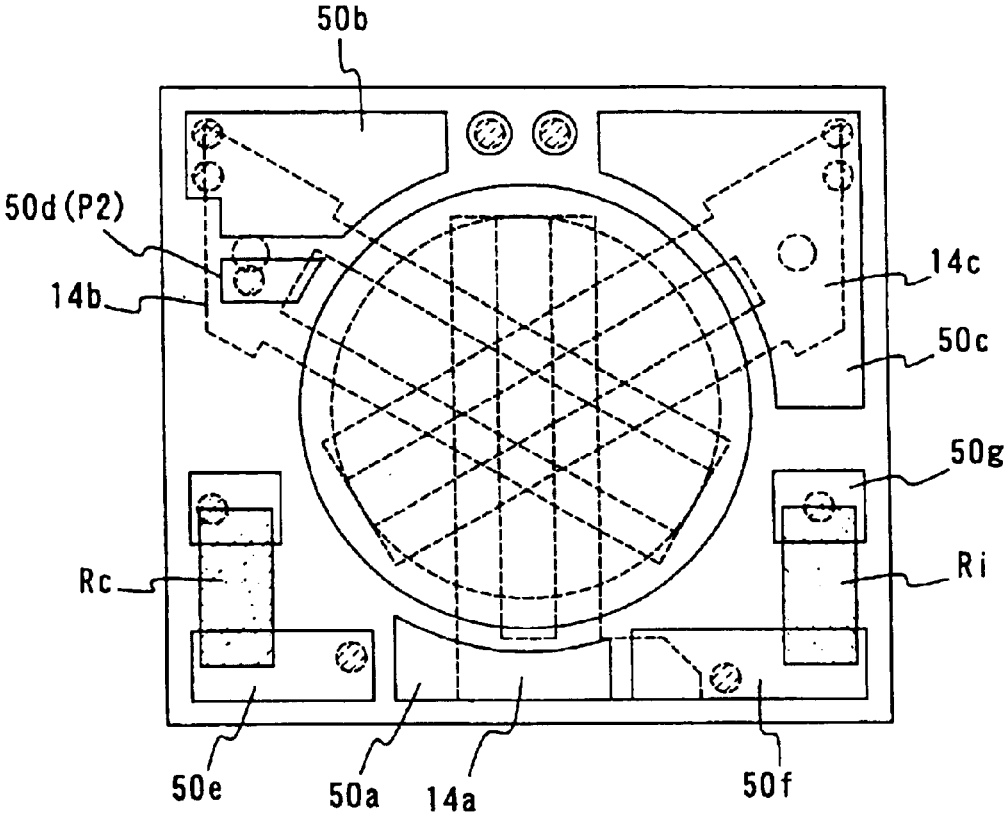
FIG. 14 is a plan view showing one example of the connection between the non-reciprocal circuit and the directional coupler in the laminate of the non-reciprocal circuit module of the present invention.

FIG. 14 shows an upper surface of the assembly 11. One end of the first transmission line 200 extends to the through-hole electrodes on an outer surface of the assembly 11 so that it is connected to an electrode 50*d* to form a terminal P2 in FIG. 1. With such a structure, the directional coupler and the non-reciprocal circuit are in a shut-off state in DC current. Accordingly, after normal operation is confirmed by measuring electric characteristics of the directional coupler, a central conductor 14*b* of the assembly 10 can be soldered to both electrode pattern 50*b* and electrode 50*d* constituting the load capacitors.

In this example, too, a small non-reciprocal circuit module having excellent electric characteristics can be obtained as in the other examples.

What is claimed is:

1. A non-reciprocal circuit module comprising (a) a permanent magnet for applying a DC magnetic field to a magnetic body, (b) an assembly comprising a plurality of central conductors and said magnetic body placed therein, each of said central conductors having a common terminal at one end and an input/output terminal for a high-frequency signal at the other end, (c) a laminate constituted by a plurality of dielectric layers having conductor layers comprising electrode patterns, ground electrodes, and line electrodes, (d) said laminate comprising a plurality of load capacitors connected to said central conductors, a first transmission line and a second transmission line magnetically coupled to said first transmission line to constitute a directional coupler, said load capacitors being formed by conductor layers (electrode patterns) opposing via said dielectric layers, said first and second transmission lines being formed by conductor layers (line electrodes) sandwiched by conductor layers (ground electrodes), through-hole electrodes being provided on dielectric layers on which one of said conductor electrodes (ground electrodes) is formed, and said first transmission line being connected to one of said central conductors on an upper surface of said laminate via said through-hole electrodes.

2. The non-reciprocal circuit module according to claim 1, wherein said laminate has a pore for receiving said assembly substantially at center, and said conductor layers (electrode patterns) constituting said load capacitors are formed on dielectric layers different from dielectric layers on which said conductor layers (line electrodes) of said first and second transmission lines are formed.

3. The non-reciprocal circuit module according to claim 1, wherein said laminate has a pore for receiving said assembly substantially at center, and said first and second transmission lines are placed such that they enclose said pore.

4. The non-reciprocal circuit module according to claim 1, wherein an electrostatic capacitor is connected to at least one end of said first transmission line in parallel with said load capacitors, thereby constituting a low-pass filter, said electrostatic capacitor being formed by electrodes for said electrostatic capacitor sandwiched by conductor layers (ground electrodes) and said conductor layers (ground electrodes), and each one end of electrodes for said electrostatic capacitor being connected to said first transmission line via other through-hole electrodes.

5. The non-reciprocal circuit module according to claim 4, wherein said high-frequency amplifier comprises a amplifier circuit comprising a transistor, an input-matching circuit connected to the input terminal of said amplifier circuit, and an output-matching circuit connected to the output terminal of said amplifier circuit, each of said input-matching circuit and said output-matching circuit having a capacitor and an inductor, said transistor of said amplifier circuit being mounted onto said laminate, and said inductor being formed as a transmission line in said laminate, wherein said low-pass filter is used as an output-matching circuit connected to the output terminal of said amplifier circuit.

6. The non-reciprocal circuit module according to claim 1, wherein an electrostatic capacitor is connected to at least one end of said first transmission line in parallel with said load capacitors, thereby constituting a low-pass filter, and said electrostatic capacitor being formed by electrodes for said electrostatic capacitor sandwiched by conductor layers (ground electrodes), and each one end of electrodes for said electrostatic capacitor being connected to said first transmission line via other through-hole electrodes, and an attenuation pole being provided at a resonance frequency of a parallel resonance circuit.

7. The non-reciprocal circuit module according to claim 1, wherein said first and or second transmission line is formed by electrically connecting a plurality of divided conductor layers placed on a plurality of dielectric layers via through-holes, and said second transmission line is connected to a resistor element formed in or mounted on said laminate via other through-hole electrodes formed in dielectric layers.

8. The non-reciprocal circuit module according to claim 1, wherein said first and/or second transmission lines are constituted by connecting two conductor layers (electrode patterns) formed on the different dielectric layers via through-holes, of which positions are changed to adjust the degree of coupling.

9. The non-reciprocal circuit module according to claim 1, wherein one of the conductor layers (ground electrode) sandwiching said first and second transmission lines is constituted by a wide conductor layer on a rear surface of said laminate, and is connected to conductor layers (electrode patterns) for said load capacitors on the ground side via through-hole electrodes.

10. The non-reciprocal circuit module according to claim 1, wherein said laminate has a first laminate region in which conductor layers constituting said first and second transmission lines are formed, and a second laminate region placed above said first laminate region, in which a plurality of load capacitors constituting a non-reciprocal circuit, are formed, and one of said conductor layers (ground electrodes) is formed between said first laminate region and said second laminate region.

11. The non-reciprocal circuit module according to claim 1, wherein said laminate further comprises a high-frequency amplifier, an output terminal of said high-frequency amplifier being connected to one end of said first transmission line by said conductor layers in said laminate.

12. A non-reciprocal circuit module comprising (a) a permanent magnet for applying a DC magnetic field to a magnetic body, (b) an assembly comprising a plurality of central conductors and said magnetic body placed therein, each of said central conductors having a common terminal at one end and an input/output terminal for a high-frequency signal at the other end, and (c) a laminate constituted by a plurality of dielectric layers having conductor layers comprising electrode patterns, ground electrodes and line electrodes, (d) said laminate comprising a plurality of load capacitors, a first transmission line, and a second transmission line magnetically coupled to said first transmission line to constitute a directional coupler, said load capacitors being formed by conductor layers (electrode patterns) opposing via said dielectric layers, said conductor layers (electrode patterns) of said plural load capacitors on the hot side and the ground side being divided for every load capacitor together with a through-hole electrode connected to conductor layers (electrode patterns) on said ground side being formed between conductor layers (electrode patterns) on said hot side formed on the same dielectric layer, said first and second transmission lines being formed by conductor layers (line electrodes), the other through-hole electrodes being provided in the dielectric layers formed said electrode layers (electrode patterns), and said first transmission line being connected to one of said central conductors via said through-hole electrodes.

13. The non-reciprocal circuit module according to claim 12, wherein said first and second transmission lines are placed such that they do not overlap with conductor layers constituting said load capacitors in a lamination direction.

14. A non-reciprocal circuit module comprising (a) a permanent magnet for applying a DC magnetic field to a plate-shaped magnetic body, (b) an assembly comprising a central conductor member comprising central conductors extending from a ground electrode formed by a thin copper plate radially in a plurality of directions, and said magnetic body, said central conductors encircling said magnetic body in a mutually insulated manner and crossing substantially at the center of said magnetic body, and (c) a laminate formed by a plurality of dielectric layers having conductor layers comprising electrode patterns, ground electrodes, and line electrodes and having a pore for receiving said assembly substantially at center, said laminate comprising a plurality of load capacitors each formed by conductor layers opposing via said dielectric layer around said pore, a first transmission line connected to any one of said central conductors, and a second transmission line magnetically coupled to said first transmission line to constitute a directional coupler, part of conductor layers (pattern electrodes) of said load capacitors on the hot side being formed on a main surface of said laminate opposing to said permanent magnet, said first transmission line being connected to a pattern electrode formed on said main surface via through-holes formed in dielectric layers, and ends of said central conductors being connected to said conductor layers (pattern electrodes) formed on said main surface of said laminate and said electrode patterns.

* * * * *

UNITED STATES PATENT AND TRADEMARK OFFICE

CERTIFICATE OF CORRECTION

PATENT NO. : 6,894,578 B1
DATED : May 17, 2005
INVENTOR(S) : Yasushi Kishimoto et al.

It is certified that error appears in the above-identified patent and that said Letters Patent is hereby corrected as shown below:

Title page, Item [54] and Column 1, line 1,
Title, "IRREVERSIBLE" should read -- NON-RECIPROCAL --.
Item [30], Foreign Application Priority Data, insert:
-- Apr. 6, 2000 (JP)……2000-105073
May 26, 2000 (JP)……..2000-157076 --.
Item [57], ABSTRACT,
Line 8, "layer:" should read -- layer; --.

Column 14,
Line 54, "a amplifier" should read -- an amplifier --.

Column 15,
Line 10, "and or" should read -- and/or --.

Column 16,
Line 15, "formed said" should read -- formed on said --.

Signed and Sealed this

Twenty-seventh Day of September, 2005

JON W. DUDAS
*Director of the United States Patent and Trademark Office*